US007128118B2

(12) United States Patent
Kramer et al.

(10) Patent No.: US 7,128,118 B2
(45) Date of Patent: Oct. 31, 2006

(54) AUTOMATED SHEET FOLDER OR BOOKLET MAKER WHICH APPLIES STICKER CLOSURES

(75) Inventors: William E. Kramer, Wolcott, NY (US); David C. van Wyngaarden, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/761,082

(22) Filed: Jan. 20, 2004

(65) Prior Publication Data

US 2005/0155716 A1 Jul. 21, 2005

(51) Int. Cl.
*B32B 37/00* (2006.01)

(52) U.S. Cl. ..... 156/542; 156/443

(58) Field of Classification Search ..... 156/538–542, 156/443, 475, 362, 477.1, 555, 582
See application file for complete search history.

(56) References Cited

U.S. PATENT DOCUMENTS 4,004,962 A * 1/1977 Kleid ..... 156/475
4,160,687 A * 7/1979 Spear ..... 156/444
5,118,375 A * 6/1992 Malachowski et al. ..... 156/216
5,279,698 A 1/1994 Davis
5,376,217 A * 12/1994 Janssen et al. ..... 156/361
5,711,846 A 1/1998 Alicea
5,980,676 A 11/1999 Meetze ..... 156/216
6,273,411 B1 * 8/2001 Vijuk ..... 270/37
6,435,245 B1 * 8/2002 Sette et al. ..... 156/475
6,769,675 B1 * 8/2004 Vijuk ..... 270/39.06

FOREIGN PATENT DOCUMENTS

DE 44 07 254 A1 9/1995
EP 0 547 788 A1 6/1993

* cited by examiner

*Primary Examiner*—James Sells
(74) *Attorney, Agent, or Firm*—R. Hutter

(57) ABSTRACT

In a finishing apparatus, such as would be used with a copier or high-speed printer, an applicator places stickers on a folded sheet or booklet, to prevent the sheet or booklet from unfolding or opening. At one point in the operation, the folded sheet or booklet is "backed up" in its basic process direction to receive a sticker on its trailing edge, and backed up further so that the sticker is folded over the trailing edge by a pair of crease rolls.

4 Claims, 2 Drawing Sheets

AUTOMATED SHEET FOLDER OR BOOKLET MAKER WHICH APPLIES STICKER CLOSURES

TECHNICAL FIELD

The present application relates to a booklet maker or sheet folding apparatus, as would be used in conjunction with a printing or copying apparatus.

BACKGROUND

Booklet makers and sheet folders are well-known devices for forming folded booklets or folded sheet sets. It is becoming common to include booklet makers and sheet folders in conjunction with office-range copiers and printers (as used herein, a "copier" will be considered a type of "printer"). In basic form, a booklet maker/sheet folder includes a slot for accumulating signature sheets, as would be produced by a printer. In booklet mode, the accumulated sheets, forming the pages of a booklet, are positioned within the stack so that a stapler mechanism and complementary anvil can staple the stack precisely along the intended crease line. In one embodiment, the creased and stapled sheet sets are then pushed, by a blade, completely through crease rolls, to form the final main fold in the finished booklet. The basic hardware of a booklet maker, such as including the crease rolls, can be controlled to provided C- or Z-folds to sheets or sets of sheets as well. The finished booklets or sheets are then accumulated in a tray downstream of the crease rolls.

Whether the final product of a booklet maker is a multi-page booklet, or a folded sheet or set of sheets, if it is desired to mail the product without an envelope, it is known to place a sticker on an edge of the product to prevent the booklet or folded sheet from opening or unfolding in the mail.

PRIOR ART

U.S. Pat. No. 5,980,676 discloses a finishing device for a copier or digital printer which places tapes along the edges of output sheet sets.

SUMMARY

According to one embodiment, there is provided an apparatus for processing sheets, comprising a roller pair forming a main nip therebetween, the roller pair being operable to move at least one sheet through the main nip in a process direction and a reverse direction opposite the process direction. A sticker applicator is operatively disposed upstream of the main nip along the process direction. A control system, operative of the roller pair and the main nip, causes the roller pair to move a sheet in the reverse direction to receive a sticker from the sticker applicator, and then to move the sheet through the main nip in the process direction.

DETAILED DESCRIPTION

Figure 1:
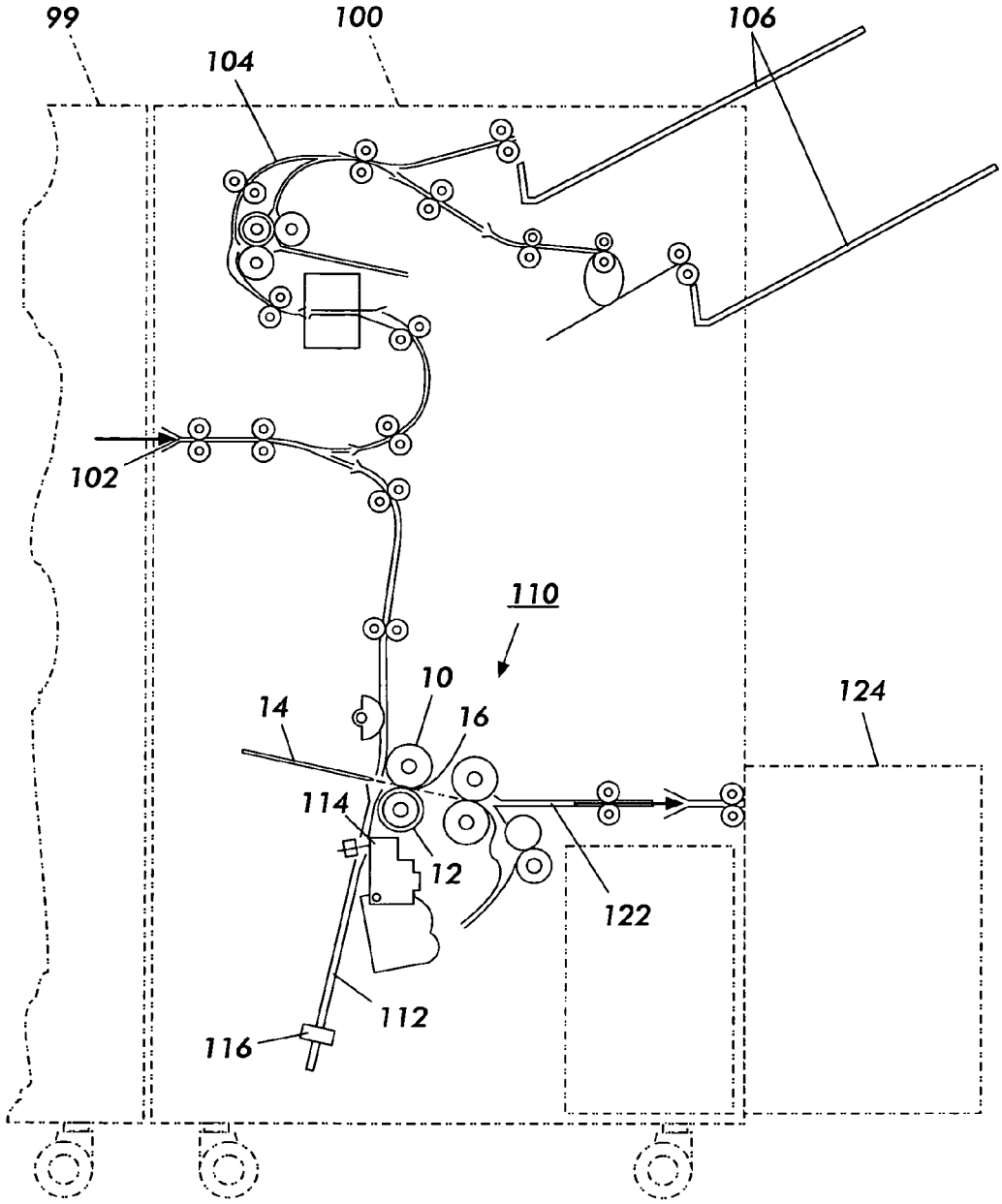
FIG. 1 PRIOR ART
FIG. 1 is a simplified elevational view of a "finisher module," including a booklet maker, as would be used with an office-range digital printer.

FIG. 1 is a simplified elevational view of a "finisher module," generally indicated as 100, including a sheet folder and booklet maker, as would be used with an office-range digital printer. Printed signature sheets from the printer 99 are accepted in an entry port 102. Depending on the specific design of finisher module 100, there may be numerous paths such as 104 and numerous output trays 106 for print sheets, corresponding to different desired actions, such as stapling, hole-punching and C- or Z-folding. It is to be understood that the various rollers and other devices which contact and handle sheets within finisher module 100 are driven by various motors, solenoids and other electromechanical devices (not shown), under a control system, such as including a microprocessor (not shown), within the finisher module 100, printer 99, or elsewhere, in a manner generally familiar in the art. For present purposes what is of interest is the booklet maker generally indicated as 110, the basic hardware of which can be used in other types of folding as well.

Booklet maker 110 defines a slot 112. Slot 112 accumulates signature sheets (sheets each having typically four page images thereon, for eventual folding into pages of the booklet) from the printer 99. Each sheet is held within slot 112 at a level where a stapler 114 can staple the sheets along a midline of the signatures, the midline corresponding to the eventual crease of the finished booklet. In order to hold sheets of a given size at the desired level relative to the stapler 114, there is provided at the bottom of slot 112 an elevator 116, which forms the "floor" of the slot 112 on which the edges of the accumulating sheets rest before they are stapled. The elevator 116 is placed at different locations along slot 112 depending on the size of the incoming sheets.

As printed signature sheets are output from printer 99, they accumulate in slot 112. When all of the necessary sheets to form a desired booklet are accumulated in slot 112, elevator 116 is moved from its first position to a second position where the midpoint of the sheets are adjacent the stapler 114. Stapler 114 is activated to place one or more staples along the midpoint of the sheets, where the booklet will eventually be folded.

After the stapling, elevator 116 is moved from its second position to a third position, where the midpoint of the sheets are adjacent a blade 14 and crease rolls 10 and 12, which form a crease nip 16. The action of blade 14 and crease rolls 10 and 12 performs the final folding, and sharp creasing, of the sheets into the finished booklet. Blade 14 contacts the sheet set along the stapled midpoint thereof, and bends the sheet set toward the nip of crease rolls 10 and 12, which draw all the sheets in and form a sharp crease. The creased and stapled sheet sets are then drawn, by the rotation of crease rolls 10 and 12, completely through the nip, to form the final main fold in the finished booklet. The finished booklets are then conducted along path 122 and collected in a tray 124.

The basic hardware of a finisher as shown in FIG. 1, especially as regards booklet maker 110, can also be controlled to create C-, and in some cases, Z-folds in sheets or sets of sheets.

Figure 2:
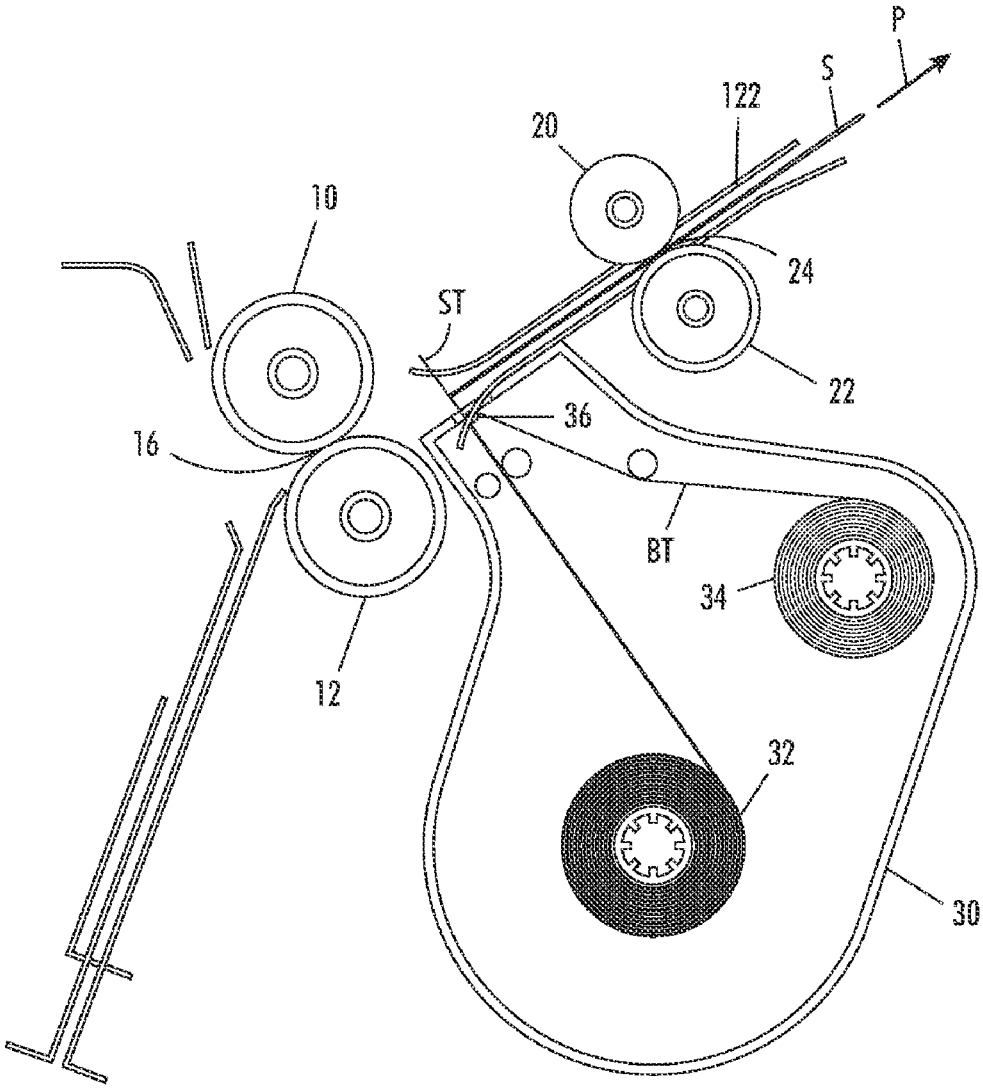
FIG. 2 is a simplified elevational view, showing an embodiment of a sticker applicator in conjunction with folding hardware.

FIG. 2 is an elevational view of a sticker applicator that can be used with the basic hardware shown in FIG. 1. As can be seen, downstream of crease rolls 10, 12 along a basic process direction (indicated as P) of the finisher module is what can be called a roller pair 20, 22, together forming what can be called a main nip 24. In this embodiment, the rollers 20, 22 are selectably controllable (through a control system and motors, not shown) to direct a sheet S disposed in main nip 24 either in the process direction P (i.e., toward the output tray, or to the right in the Figure) or, as needed, in a reverse direction opposite the process direction P (i.e., toward the crease nip 16, or toward the left in the Figure). In this way, as part of a process, the rollers 20, 22 can "back up" a folded sheet or set of sheet some distance as needed at certain times.

In FIG. 2, a sheet indicated as S, which in this view has emerged from folding through crease nip 16 and is disposed in main nip 24, can in practice be a single sheet, or set of sheets, which has been folded once or in a C- or Z-shape, or can be a multi-sheet, and possibly stapled, booklet. (In any case, for present purposes, a booklet or other folded set of sheets will include at least one sheet.) The trailing edge of such a sheet S along the process direction P is "open," or in other words, not a fold line, and therefore, once the sheet exits the system and is mailed, the sheet is liable to unfold. It is therefore desirable to place a sticker over the open, trailing edge of the sheet S, in effect to keep the sheet folded or the booklet closed.

Disposed between crease rolls 10, 12 and roller pair 20, 22 is what can generally be called a sticker applicator 30. The applicator 30 provides stickers (such as small pieces of paper or tape, having adhesive on one side thereof) and applies the stickers to the trailing edge (relative to process direction P) of a sheet S held in main nip 24.

The sticker applicator 30 in this embodiment includes a dispenser having a supply spool 32 for retaining a supply of stickers on substrate such as backing tape, and take-up spool 34 for taking up the tape as sticker are removed. As shown, the sticker-bearing tape is threaded around a pin 36, which causes a sharp turn in the motion of the backing tape BT; as the backing tape BT makes the sharp turn, a single sticker ST is effectively peeled from the backing tape and disposed along the path of a sheet S. The backing tape BT would typically be pulled by a friction roller nip (not shown) associated with take-up spool 34. Because of the large variation in diameter of the take-up spool 34 over the course of its use, it is preferably over-driven with a slipping drive. The main body of sticker applicator 30 can be in the form of an easily replaceable cartridge, so that a spent roll of backing tape on take-up spool 34 can be quickly replaced with a new roll of backing tape on supply spool 32.

Because a sticker ST must be placed on a trailing edge of a sheet passing mainly through the process direction, the roller pair 20, 22 is controlled to momentarily "back up" the sheet S so that the trailing edge of the sheet S is pushed against the sticky (toward the right in the Figure) side of the sticker ST. At an appropriate moment, the applicator interposes a sticker ST in a path of a folded sheet S moving in the reverse direction. In one embodiment, the sheet S can be backed up to such an extent that the sticker ST is placed on the trailing edge and the trailing edge is backed up into crease nip 16, where the sticker ST is folded down by the crease nip 16 over the trailing edge of sheet S. In this embodiment, the crease rolls 10, 12 function both to perform a main fold in the sheet S as it moves in the process direction and fold the sticker ST when the sheet moves in the reverse direction. Once the sticker ST is placed on and folded over the trailing edge of sheet S, the direction of roller pair 20, 22 is again reversed to push the sheet through the process direction (to the right in the Figure) and to an output tray as desired.

In a practical application of the apparatus in FIG. 2, the spooling of the backing tape BT around pin 36 is coordinated with the motion of a sheet or booklet past sticker applicator 30 so that, at times in the process when the sheet S is moving in the process direction past the sticker applicator 30, a sticker ST is not peeled off and placed in the path; rather, the sticker ST is peeled from the backing tape and placed in the path only at such time as the roller pair 20, 22 is "backing up" the sheet S to receive the sticker. This coordination of the actions of applicator 30 (in particular, of take-up spool 34) with the motion of a sheet S can be carried out by precise timing of the motion of the hardware, or with a mechanical or optical feedback system (not shown) governing the motion of the backing tape and/or the sheet S. An optical feedback system governing the backing tape BT could exploit, for instance, synchronization marks or holes on the backing tape BT, such as between each sticker ST.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A system for processing sheets, comprising:

a roller pair forming a main nip therebetween, the roller pair being operable to move at least one sheet through the main nip in a process direction and a reverse direction opposite the process direction;

a sticker applicator operatively disposed upstream of the main nip along the process direction, the sticker applicator configured to place a sticker on a trail end of a sheet relative to the process direction;

a set of crease rolls, forming a folding nip operatively disposed upstream of the sticker applicator along the process direction, the crease rolls being operable to fold at least one sheet passing through the folding nip along the process direction and to fold a sticker applied to a sheet moving along the reverse direction; and a control system, operative of the roller pair and the main nip, the control system causing the roller pair to move a sheet initially in the process direction, then temporarily move the sheet in the reverse direction to receive a sticker from the sticker applicator, and then to move the sheet having the sticker thereon through the main nip in the process direction.

2. The system claim 1, the sticker applicator interposing a sticker in a path of a sheet moving in the reverse direction from the main nip.

3. The system of claim 1, the sticker applicator including a dispenser for taking a sticker from a backing substrate.

4. The system of claim 1, the sticker applicator including a spool for retaining a supply of backing substrate.

* * * * *